US005901697A

United States Patent [19]

Oliver, Jr. et al.

[11] Patent Number: 5,901,697

[45] Date of Patent: May 11, 1999

[54] PORTABLE ARTIFICIAL CAMPFIRE

[75] Inventors: Howard C. Oliver, Jr., Littleton; Patrick A. Marshall, Lakewood, both of Colo.

[73] Assignee: PortaFire, Inc., Littleton, Colo.

[21] Appl. No.: 09/038,419

[22] Filed: Mar. 11, 1998

Related U.S. Application Data

[60] Provisional application No. 60/040,588, Mar. 17, 1997.

[51] Int. Cl.[6] ..... F24C 3/04

[52] U.S. Cl. ..... 126/92 AC; 126/41 R; 126/512; 126/519; 431/125

[58] Field of Search ..... 126/9 R, 9 A, 126/9 B, 25 R, 25 A, 29.3, 41 R, 512, 519, 92 R, 92 AC, 25 B; 431/328, 329, 125, 126

[56] References Cited

U.S. PATENT DOCUMENTS

| | | | |
|---|---|---|---|
| 254,709 | 3/1882 | Sheldon | 126/41 |
| 2,950,714 | 8/1960 | Sterick | 126/92 R |
| 3,326,265 | 6/1967 | Paulin | 126/92 R |
| 3,362,395 | 1/1968 | Peterson | 126/92 |
| 3,385,651 | 5/1968 | Rasmussen et al. | 431/328 |
| 3,593,647 | 7/1971 | Copeland | 99/259 |
| 4,903,683 | 2/1990 | Larsen et al. | 126/25 B |
| 5,094,223 | 3/1992 | Gonzalez | 126/25 R |
| 5,413,087 | 5/1995 | Jean | 126/41 R |
| 5,421,321 | 6/1995 | Ward | 126/519 |
| 5,495,845 | 3/1996 | Hait | 126/29 |

*Primary Examiner*—James C. Yeung
*Attorney, Agent, or Firm*—John L. Isaac

[57] ABSTRACT

A portable artificial campfire device is disclosed. The device includes a receptacle having upper and lower portions, an open top defined by a peripheral edge of the upper portion, and an interior bottom surface. A burner is positioned above the interior bottom surface and is adapted to provide a flame of variable height. A pressurized fuel source is positioned exterior to the receptacle, and a control member couples the fuel source with the burner for controlling the flow of fuel to the burner and the size of flame emitted by the burner. A plurality of artificial refractory log members are secured to each other in crisscross fashion to form a log cluster. A structure is provided for supporting the log cluster within the receptacle. Finally, a mechanism is provided for selectively adjusting the vertical position of the log cluster in the receptacle to vary the vertical position of the log cluster relative to the plane the open top.

20 Claims, 7 Drawing Sheets

PORTABLE ARTIFICIAL CAMPFIRE

RELATED APPLICATION

This is a continuation-in-part of U.S. Provisional Patent Application Serial No. 60/040,588, filed Mar. 17, 1997, the contents of which are specifically incorporated herein by reference.

BACKGROUND OF THE INVENTION

1. Field of the Invention

The present invention relates generally to gas burner devices and, more particularly, to devices using compressed gas and artificial logs. Specifically, the present invention relates to portable devices utilizing compressed gas for cooking and alike.

2. Description of the Prior Art

Portable fireplaces and fire pits are used by campers and homemakers to provide outdoor heat, cooking as well as the pleasant appearances of a campfire. In addition, portable devices using compressed gas, such as bottled propane, have often been used as cooking devices in the outdoors. There are many examples of such devices. For example, U.S. Pat. No. 254,709, U.S. Pat. No. 3,593,647 and U.S. Pat. No. 5,413,087 all disclose portable cooking devices that are operated utilizing pressurized fuel such as pressurized white gas and propane gas.

Other portable devices utilize compressed gas in combination with other fuel sources. These devices are generally intended to be utilized in the outdoors. U.S. Pat. No. 4,903,683 illustrates a system which incorporates charcoal in conjunction with pressurized gas. On the other hand, U.S. Pat. No. 5,094,223 discloses a portable fire pit grill device that combines pressurized gas with the burning of real wood.

Unfortunately, all of the above noted devices are specifically cooking devices adapted for portability to enable cooking in the outdoors. None of these devices utilize artificial or refractory logs. U.S. Pat. No. 3,362,395, U.S. Pat. No. 3385,651 and U.S. Pat. No. 5, 421,321 all disclose artificial fireplaces utilizing refractory logs and natural gas. These systems are designed to provide the pleasant appearance of fireplaces without the mess and difficulty of using real wood. However, they are all permanent installations generally designed for use indoors and are certainally not adaptable for portable use in the outdoors A traditional and almost essential part of camping in the outdoors, however, is having a wood burning campfire, particularly in the evening. An open campfire provides both warmth as well as pleasant visual experiences. Unfortunately, there are many times that wood burning and open campfires are prohibited due to dry forest or environmental conditions. When such dry conditions prevail, fire danger is high. In such instances, the Forest Service restricts and even prohibits the burning of wood of any sort, and particularly open campfires. When such prohibitions are in force, traditional gas stoves such as described above may be utilized for cooking. However, there is to date no device which can substitute for an open campfire when such prohibitions are in force. Moreover, there is certainly no device which combines both the usefulness of a gas cooking stove with the beauty and enjoyment of an open campfire without requiring the burning of wood.

SUMMARY OF THE INVENTION

Accordingly, it is one object of the present invention to provide a portable campfire device which operates on pressurized gas.

It is another object of the present invention to provide a portable campfire device which does not require the use of real wood so that it can be operated during wood burning prohibition periods.

Yet another object of the present invention is to provide a portable gas operated cooking device that can also be utilized as an artificial campfire.

Still another object of the present invention is to provide an artificial campfire utilizing refractory logs which can also be operated as a cooking device.

To achieve the foregoing and other objects and in accordance with the purpose of the present invention, as embodied and broadly described herein, a portable artificial campfire device is disclosed. The device includes a receptacle having upper and lower portions, an open top defined by a peripheral edge of the upper portion, and an interior bottom surface. A burner is positioned above the interior bottom surface and is adapted to provide a flame of variable height. A pressurized fuel source is positioned exterior to the receptacle, and a control member couples the fuel source with the burner for controlling the flow of fuel to the burner and the size of flame emitted by the burner. A plurality of artificial refractory log members are secured to each other in crisscross fashion to form a log cluster. A structure is provided for supporting the log cluster within the receptacle. Finally, a mechanism is provided for selectively adjusting the vertical position of the log cluster in the receptacle to vary the vertical position of the log cluster relative to the plane the open top.

BRIEF DESCRIPTION OF THE DRAWINGS

The accompanying drawings which are incorporated in and form a part of the specification illustrate preferred embodiments of the present invention and, together with a description, serve to explain the principles of the invention. In the drawings.

DETAILED DESCRIPTION OF THE PREFERRED EMBODIMENTS

Figure 1:
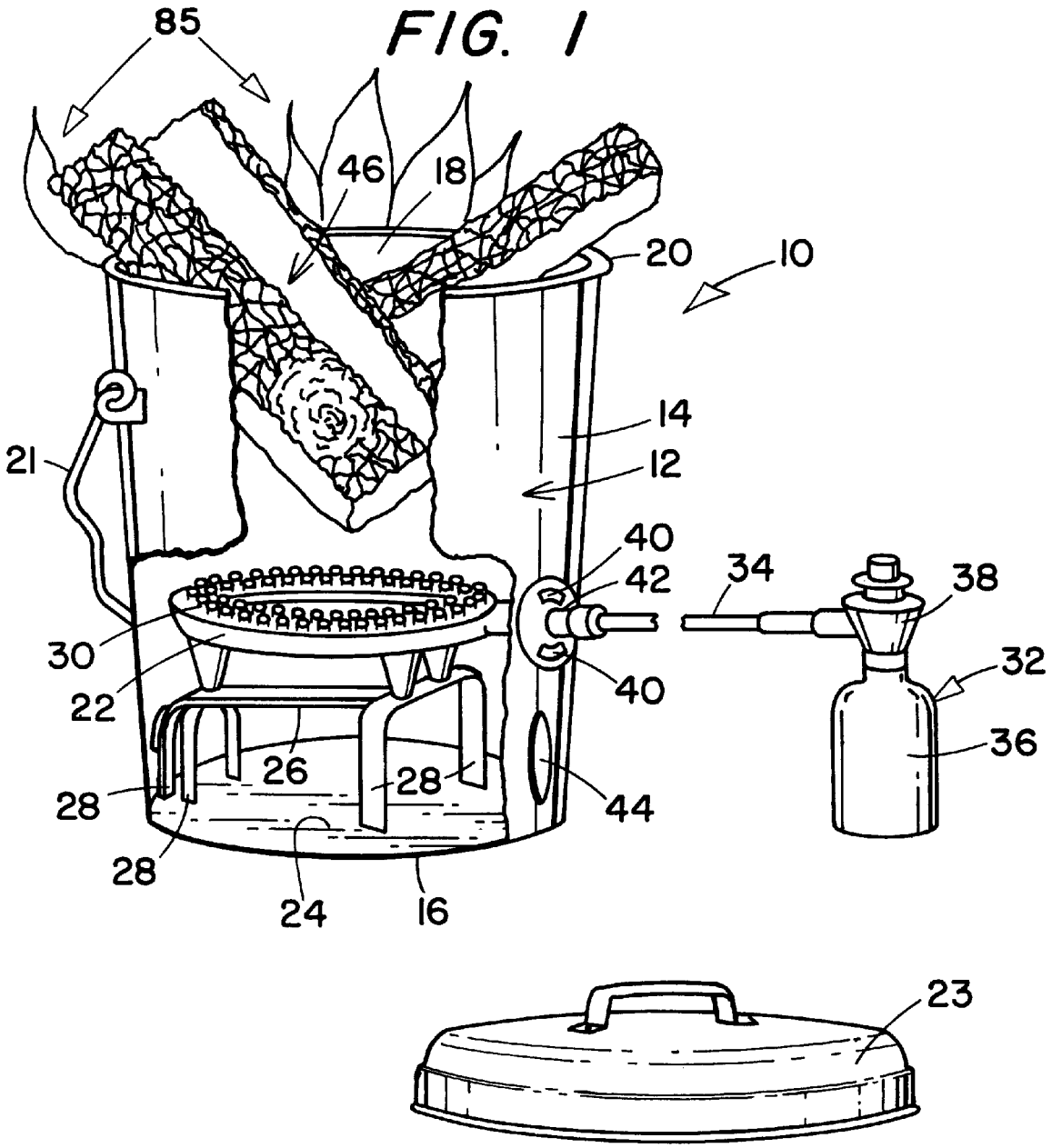
FIG. 1 is a front perspective view, with some parts broken away, of one embodiment constructed in accordance with the present invention.

Referring first to FIG. 1, a portable artificial campfire device 10 includes a receptacle or container 12 preferably in the form of a bucket-like device or corrugated can. The container 12 preferably includes an annular side portion 14, a bottom 16 and an open top 18. A peripheral lip 20 is disposed at the top edge of the container 12 to define the open end 18. In one preferred form, the container 12 is a 6-gallon, 18-gage galvinized steel bucket 14.5 in. hign, 12 in. wide at the open top 18, and 11 in. wide at the bottom 16. The container 12 preferably includes a handle 21 which is used to carry the container 12 as well as to lock over a lid 23 when the lid 23 is disposed over the open top 18 and lip 20. In this manner, the device 10 is fully portable as well as being fully self-enclosed.

A burner 22 is provided in the lower portion of the container 12 preferably spaced above the interior bottom surface 24. In preferred form, a support base 26 having a plurality of legs 28 is disposed on the bottom interior surface 24 and is sized and shaped to carry the burner 22. Preferably, the legs 28 are sized so as to position the burner 22 at least four inches, and preferably at least 4–6 in., above the interior bottom surface 24. The purpose for this positioning of the burner 22 is so that the burner 22 does not come too close to the bottom surface 24 to prevent overheating and possible fire danger. In one preferred form, the base 26 is made of several ½-inch steel bars bent 4 in. at each end at a 90° angle to form the legs 28.

The burner 22 is preferably an 8 inch cast iron 40,000 BTU L.P. gas burner which includes a plurality of burner nozzles 30 sized and spaced so as to provide a wide flame area emitted therefrom. A source of pressurized fuel 32 is secured to the burner 22 by way of tubing 34, preferably L.P. gas low pressure hose. In preferred form, the pressurized fuel 32 is compressed propane in the form of a 16.4 oz. disposable bottle of L.P. gas 36 or a 20 pound bottle of L.P. gas with adaptor that is refillable. A control valve or gas regulator 38 is utilized to control the flow of pressurized fuel from the fuel source 32 to the burner 22. The valve 38 may be a 3-way gas regulator when the gas source 32 is in the form of a disposable L.P. gas bottle 36. It should be understood, however, that any type of pressurized gas source may be utilized in the present invention, such as pressurized white gas commonly used with camping stoves, and the like.

An adjustable air control vent 40 is provided proximate the entry point 42 where the tube 34 passes into the container 12. In addition, other air venting mechanisms may be utilized. In this particular illustrated embodiment, a vent aperture 44 is positioned beneath the entry point 42 to provide additional air ventilation within the container 12 and for the burner 22. Another venting arrangement includes the use of four 2 inch holes, three of which are 1 inch from the bottom 16 and 1½ inches apart and which are provided for air supply, while the remaining hole is used for the line 34 at entry point 42 as well as for the aperture 40. Other venting arrangements may be utilized as desired, and additional venting mechanisms are disclosed in FIGS. 5 and 6 as described below.

Figure 2:
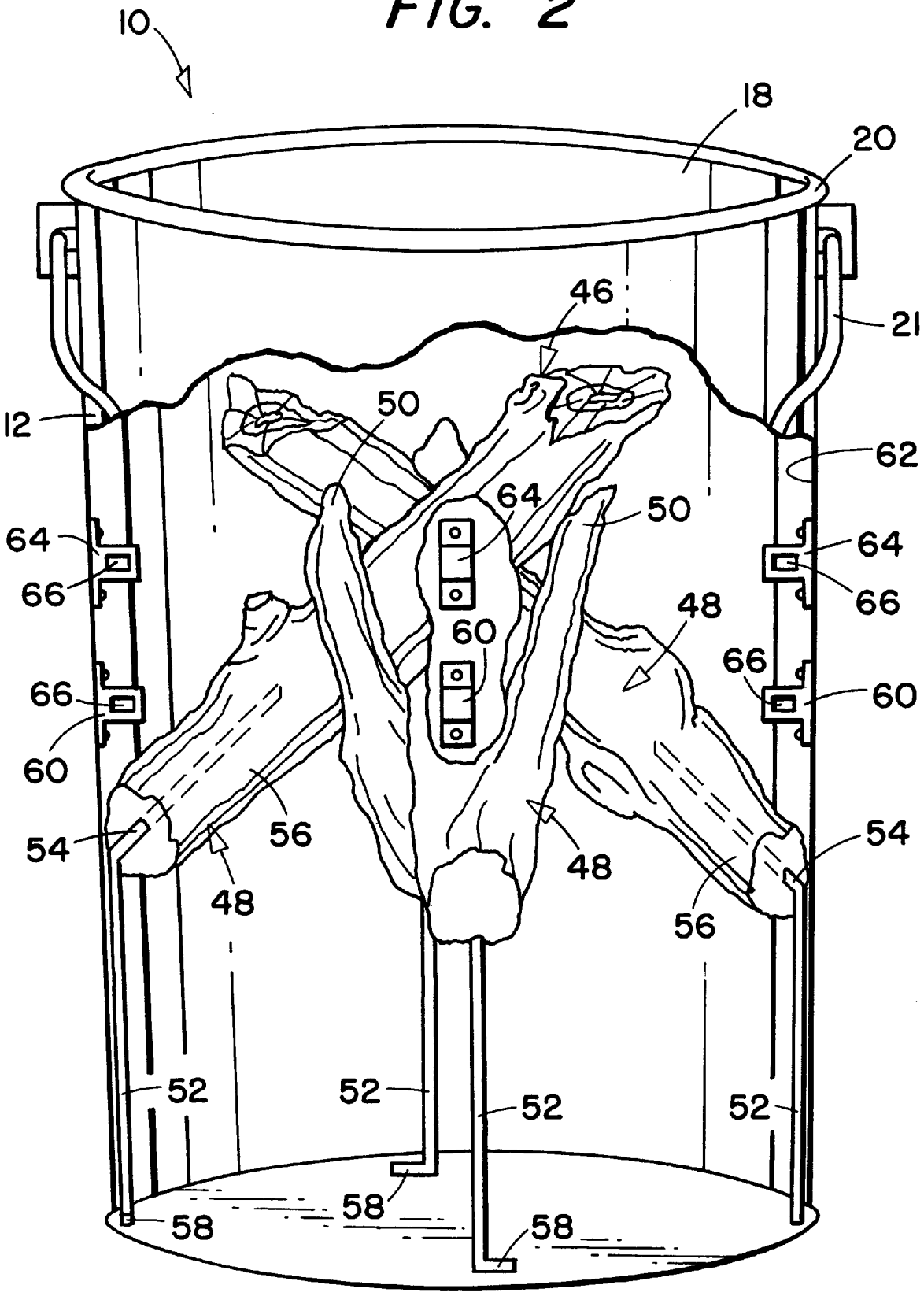
FIG. 2 is a front perspective view of the log cluster arrangement positioned within a container and constructed in accordance with the present invention.

Referring now to FIGS. 1 and 2, a log cluster 46 is positioned within the container 12. The log cluster 46 is made up of a plurality of interconnected refractory log members 48. In preferred form, each log member 48 is made fron ceramic and is approximately 9 inches long, although any type of appropriate material may be used. There are at least three log members 48 which are secured to each other in a crisscross arrangement to simulate a tepee-shaped campfire made from traditional wooden logs. The log members 48 preferably include branched portions 50 which interlock with the other logs 48 to assist in securing the logs 48 to each other as well as in simulating a tepee-shaped campfire. The logs 48 may be secured to each other in any known manner such as by bolts, refractory cement and the like. The logs 48 both retain and emit heat just like a real wood campfire, and this feature is coupled with the capability of instantly generating either a small hot blue flame or a large natural orange flame of variable height.

The log cluster 46 is positioned within the container 12 in an upwardly oriented manner. In preferred form, the log cluster 46 may be selectively positioned in any one of several vertical alignment positions. To accomplish this, a plurality of support members 52 are secured to the logs 48 and arranged to support the log cluster 46 in any one of its several vertical positions. In preferred form, each support member 52 includes a support arm having an upper portion 54 embedded in a lower portion 56 of a log member 48. The lower or distal end of each support member 52 includes a foot member 58. In preferred form, each foot member 58 is an L-shaped support element sized and shaped to engage the internal bottom surface 24 of the container 12. The support members 52 are sized so that when the feet 58 are resting on the surface 24, the log cluster 46 is positioned entirely within the container 12 below the plane of the open end 18. This first vertical position of the log cluster 46 is for storage and transport as described above or for cooking, as described below.

A first set of a plurality of attachment members 60 are positioned about the interior surface 62 of the side 14, while a second set of a plurality of attachment members 64 are likewise positioned about the interior surface 62. While only two sets of attachment members are illustrated in this embodiment, it should be understood that only one set or more than two sets may be utilized in the present invention. In the illustrated embodiment, there are preferably an equal number of attachment members 60 as there are support members 52. Likewise, there are an equal number of attachment members 64 as there are support members 52. The attachment members 60 are preferably aligned in a single plane which is substantially parallel to the plane of the peripheral lip 20. Likewise, the attachment members 64 are aligned in yet another plane which is preferably substantially parallel to the planes of the members 60 and the peripheral lip 20. Each attachment member 60 and 64 is sized and shaped to selectively receive a foot member 58. In preferred form, each attachment member 60 and 64 is in the form of a clevis secured to the inner surface 62 of the wall 14. Each attachment clevis 60 and 64 includes a central socket 66 that is oriented laterally along the periphery of the inner surface 62. Each socket 66 is sized and shaped to receive a foot member 58 therewithin.

Since the foot member or support element 58 is substantially L-shaped so as to be generally perpendicular to the support arm 52, the log cluster 46 is preferably rotated in order to engage the foot members 58 within the sockets 66 of the attachment members or clevis 60 and 64. In the illustrated embodiment, there are four support arms 52 associated with the log cluster 46. Correspondingly, there are four attachment members 60 which are spaced peripherally about the inner surface 62 in a manner which corresponds to the spacing of the support members 52. In this manner, all of the foot members 58 can be aligned adjacent to attachment members 60 so that as a log cluster 46 is rotated, all of the foot members 58 engage the sockets 66 of the attachment members 60. Likewise, the attachment members 64 are spaced peripherally about the inner surface 62 so as to be in alignment with the support members 52 and their corresponding foot members 58.

The attachment members 60 and the common plane that they are arranged in define a second vertical position for the log cluster 46 within the container 12 wherein the log cluster 46 extends partially upwardly beyond the open top 18. In this position, the logs 48 project partially above the peripheral edge 20. The second set of attachment members 64 and the plane that they lie in define a third vertical position for the log cluster 46 wherein substantially the entire log cluster 46 projects upwardly beyond the open top 18. Thus, the log cluster 46 may be readily moved between its first, second and third vertical positions within the container 12 by simply rotating the log cluster 46 so as to disengage the foot members 58 from the attachment members 60 or 64. The log cluster 46 is then moved vertically within the container 12 to the desired vertical position. If the desired a vertical position is the first vertical position, the foot members 58 are simply placed on the inner bottom surface 24. If the desired vertical position is either the second or third vertical position, then the foot members 58 are simply aligned next to the desired attachment members 60 or 64, and the log cluster 46 rotated so as to engage the foot members 58 with the w desired attachment members 60 or 64.

Figure 3:
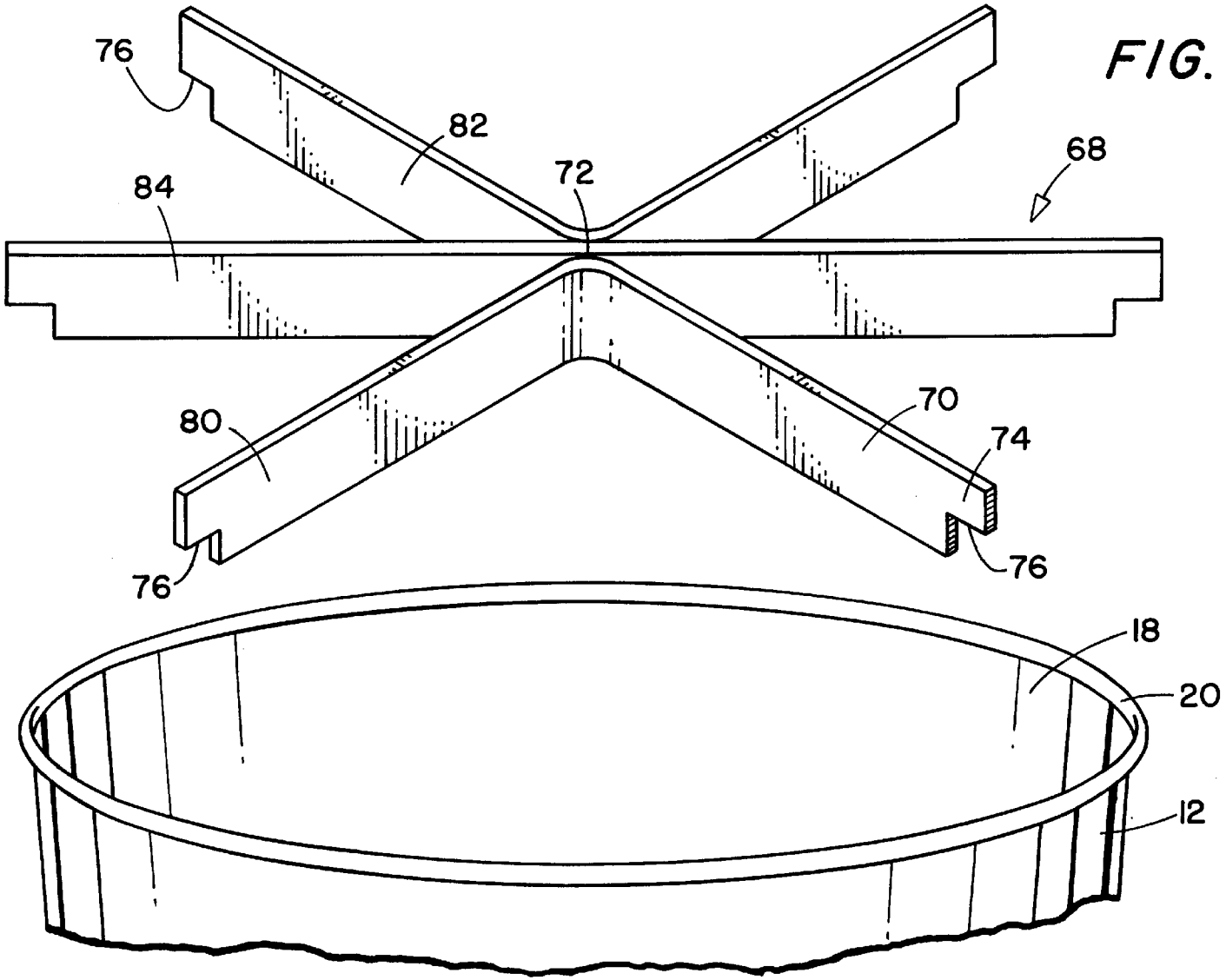
FIG. 3 is an enlarged perspective view of one embodiment of the grill member constructed in accordance with the present invention.
Figure 4:
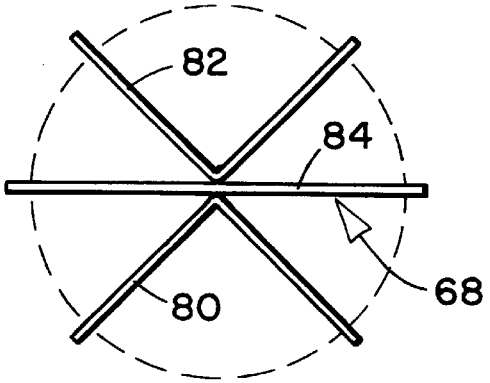
FIG. 4 is a reduced top plan view of a grill member constructed in accordance with the present invention.

The device 10 can be utilized either as an artificial campfire or as a gas fueled cooking device. When it is desired to utilize the device 10 as a cooking device, a grill member 68 is provided and sized and shaped for positioning over the open top 18. In one preferred form and as illustrated in FIGS. 3 and 4, the grill member 68 includes a plurality of spoke arms 70 radiating outwardly from a central hub 72. The distal end 74 of each spoke arm 70 includes a notch 76 sized and positioned for engagement with the peripheral lip 20. In the illustrated embodiment, the spoke arms 70 are created by utilizing three metal members 80, 82 and 84, each preferably ¾ inch in height to permit air to easily flow into and out of the device 10 between the metal members 80. 82 and 84 even if the top of the grill member 68 is completely covered, such as by a pan. The metal members 80 and 82 are preferably bent at their mid-portions at about 90° to form two right-angled members which are then welded or otherwise attached to the opposite sides of the remaining metal member 84. This arrangement forms one embodiment of a grill member 68.

Figure 5:
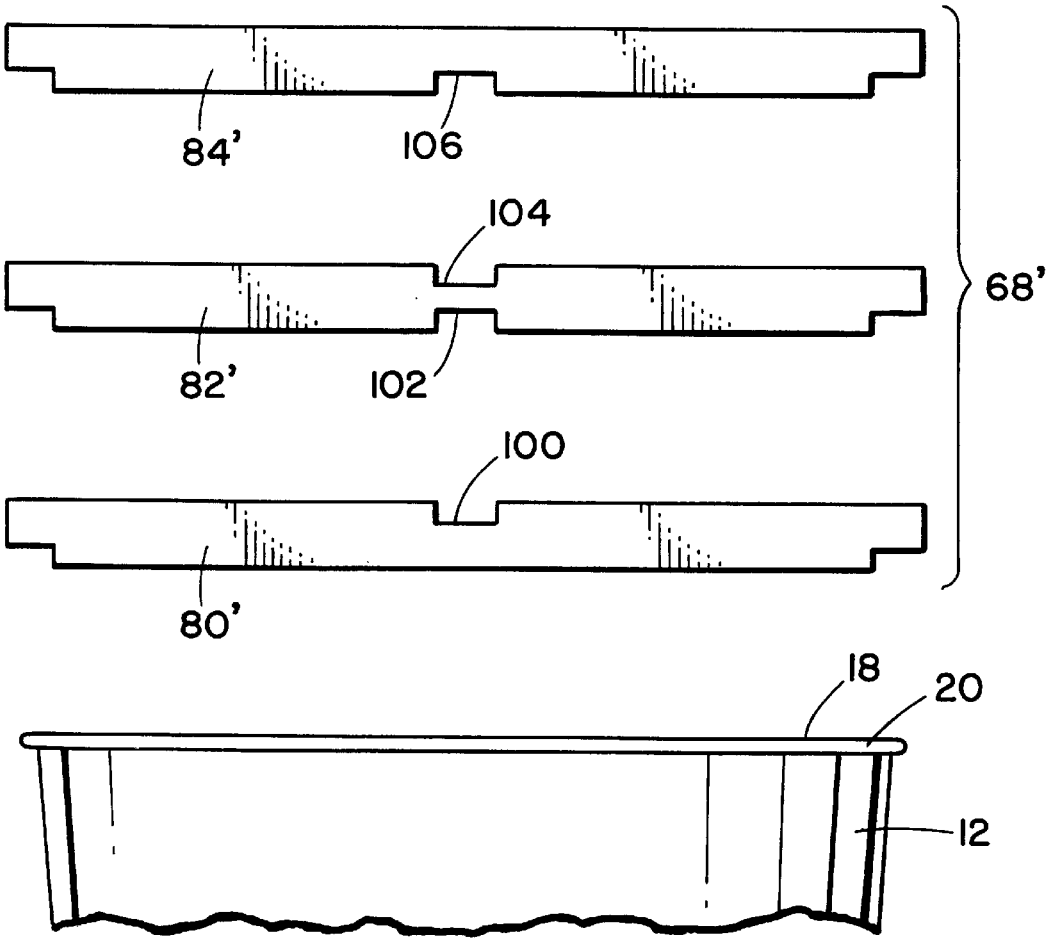
FIG. 5 is an enlarged, exploded side view of a second embodiment of the grill member constructed in accordance with the present invention.
Figure 6:
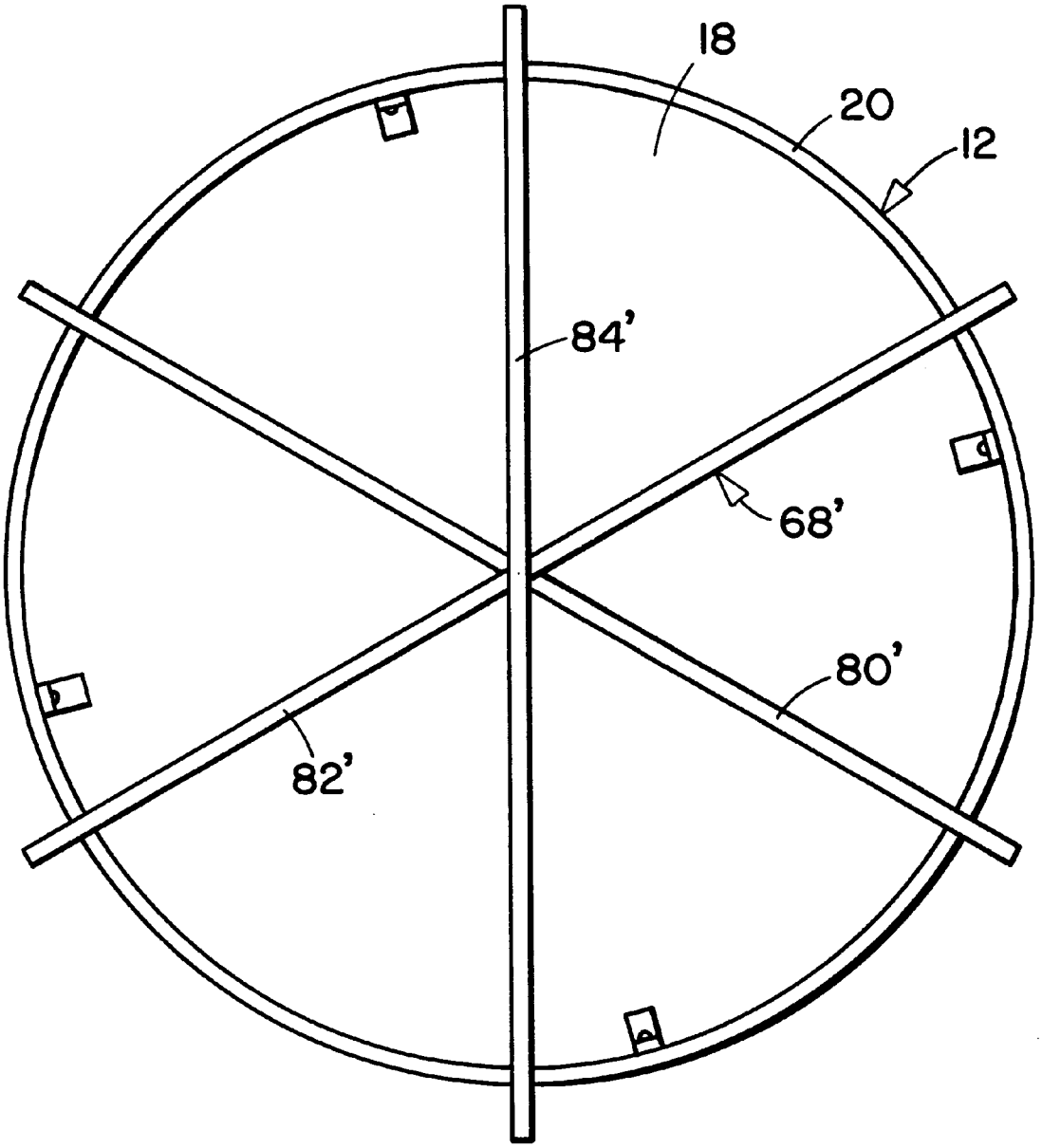
FIG. 6 is top plan view of the grill member of FIG. 5 in position on a c\ontainer in accordance with the present invention.

An alternate form for the grill member is illustrated in FIGS. 5 and 6. In this embodiment, the grill member 68' includes a bottom metal bar 80', a middle metal bar 82' and a top metal bar 84'. In this embodiment, the grill member 68' is readily disassembled so that a person can place the grill member 68' easily within the container 12 when the device 10 is not in use. The bottom bar 80' includes a center notch 100 in the upper center portion thereof, the notch 100 being about ½ inch in depth and just slightly less in width. The middle bar 82' preferably includes two notches 102 and 104 disposed opposite each other at the approximate center of the bar 82', the notch 102 being sized to snugly engage the notch 100 of the bottom bar 80'. Finally, the top bar 84' also includes a notch 106 in its lower center portion sized so as to engage the notch 104 of the middle bar 82'. In this manner, the bars 80', 82' and 84' can all be connected at their respective notches 100, 102, 104 and 106 to form a fully assembled grill member 68' to engage the lip portion 20 of the container 12. The bars 80', 82' and 84' are also preferably about ¾ inch in height as with the grill member members 80, 82 and 84 for the same reason set forth above. When it is desired to store or transport the device 10, the grill memberr 68' can be simply disassembled and the bars 80', 82' and 84' placed within the container 12.

It should be understood, however, that any type of grill construction may be utilized as the removable grill member 68 or 68' with the present invention. When the device 10 is utilized as a cooking device, the log cluster 46 is positioned in its first vertical position wherein the log cluster 46 is located entirely within the container 12 below the plane of the open top 18. In this manner, the grill member 68 or 68' may be placed onto the peripheral lip 20 over the open top 18 without contacting the log cluster 46. A flame 85 (FIG. 1) may then be created by lighting the burner 22 fueled by the gas source 32. Once the refractory logs 48 have been heated, the gas flow from the gas source 32 may then be reduced so as to lower the flame 85 for cooking, since the refractory logs 48 will continue to radiate heat.

Figure 7:
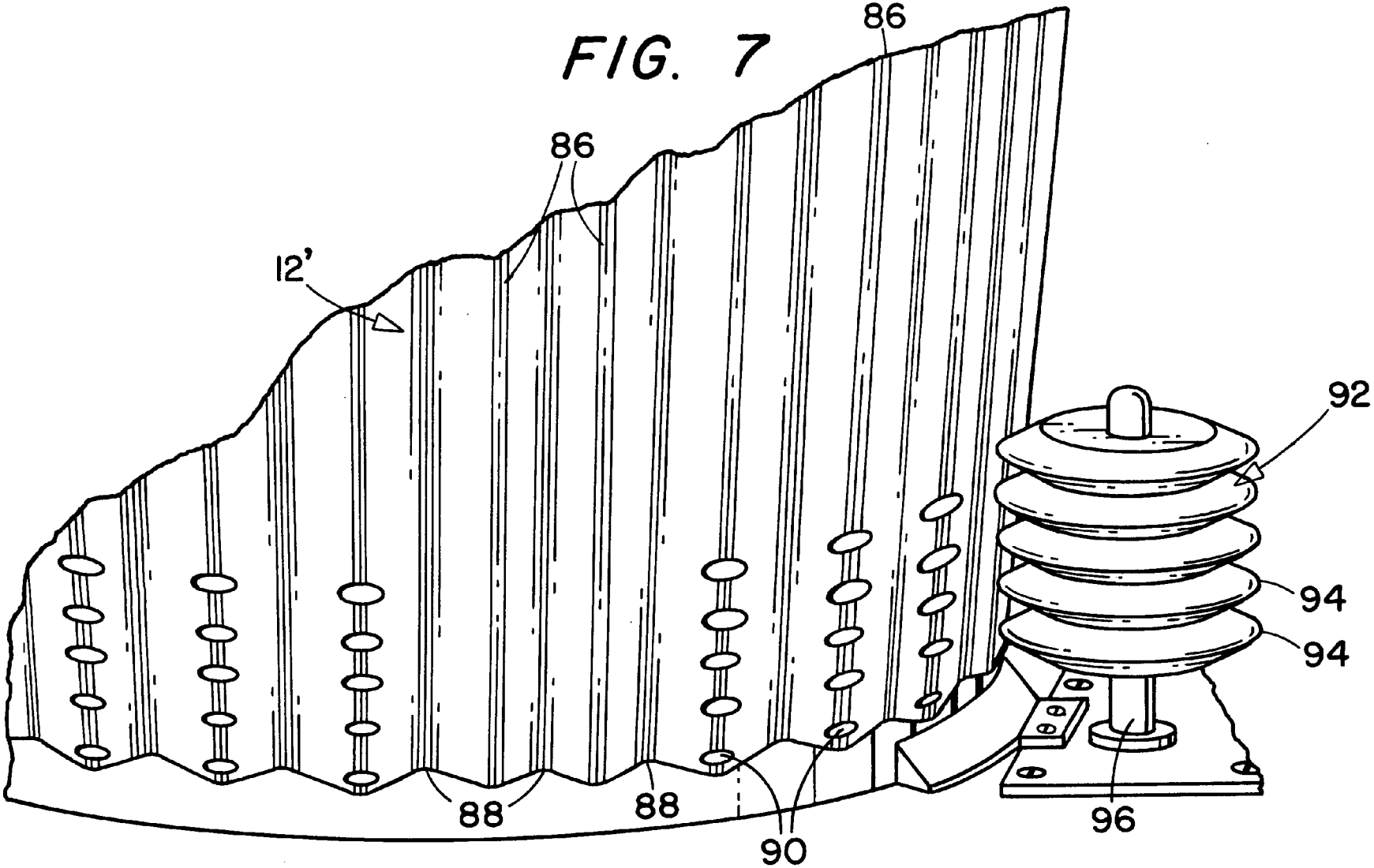
FIG. 7 is an enlarged perspective view illustrating an alternate embodiment of the venting arrangement of the present invention.
Figure 8:
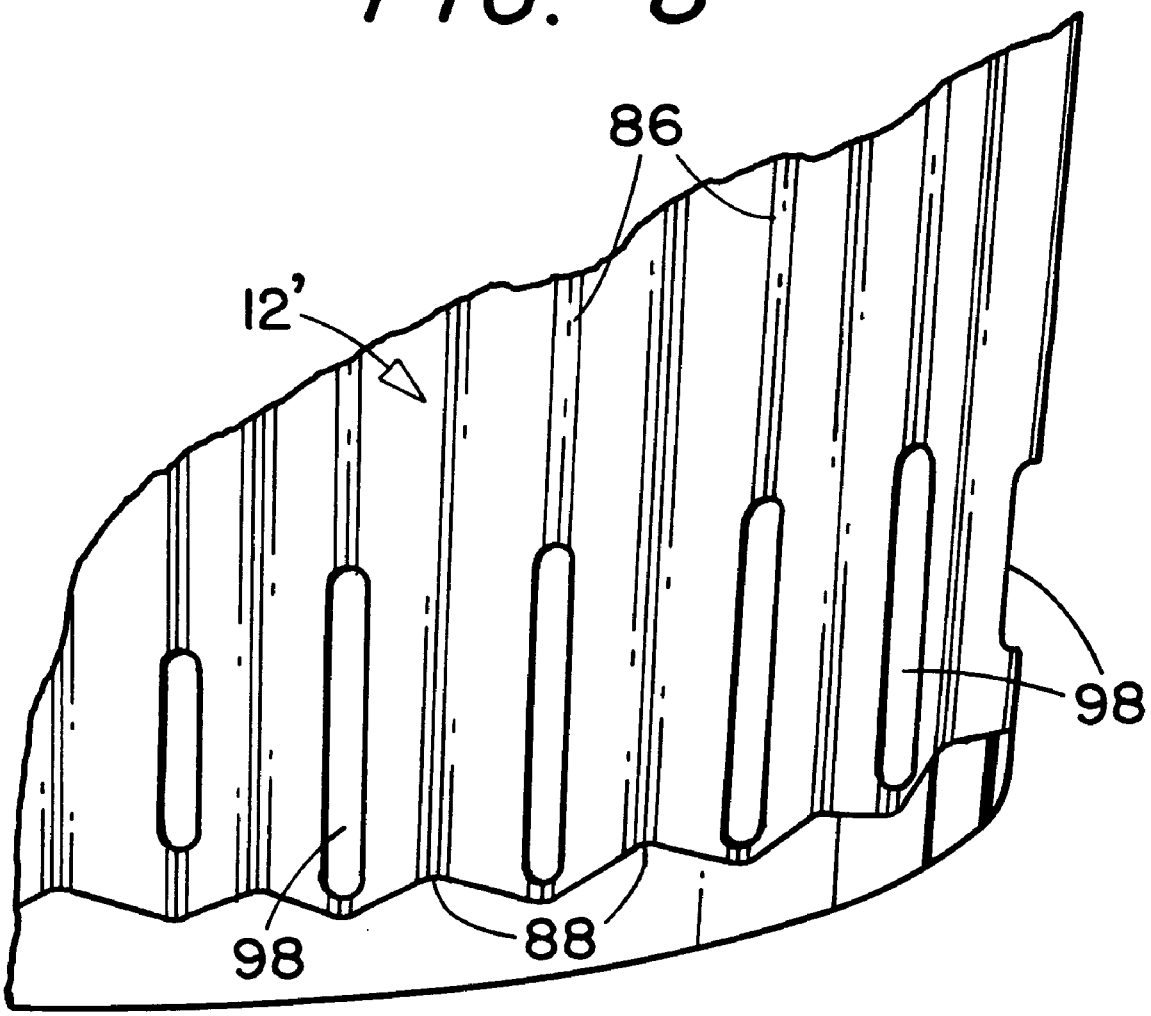
FIG. 8 is yet another embodiment of the venting arrangement of the pressent invention.

Referring now to FIGS. 7 and 8, the ventilation mechanism for the container 12 may be constructed in various forms as previously described. In FIG. 7, the container 12' is in the form of a corrugated can having exterior ridges 86 with valleys 88 disposed therebetween. The venting mechanism of this embodiment is in the form of a plurality of apertures 90 that are formed along each exterior ridge 86. There may be one or a plurality of apertures 90 along each ridge 86 depending upon the amount of desired ventilation. One manner of creating the ventilation apertures 90 is illustrated in FIG. 7 and includes using a rotary cutting mechanism 92. The cutting mechanism 92 includes a plurality of round cutting blades 94 stacked on top of each other. The cutting mechanism 92 is mounted for rotation on a shaft 96 so that as the mechanism 92 rotates about the shaft 96, the container 12' is pressed against the blades 94 and rotated counter-clockwise to the rotation of the device 92. This creates the apertures 90 along the ridges 86. In FIG. 8, the ventilation mechanism is in the form of elongated slots or channels 98 formed along the ridges 86 of the container 12' instead of a plurality of small apertures as in the embodiment of FIG. 7.

As previously described, the first vertical position of the log cluster 46 is generally utilized for either transporting or storing the device 10 or for using the device 10 as a cooking device. When it is desired to use the device 10 as an artificial campfire, the log cluster 46 may be moved to its second vertical position and then dialed or rotated to lock it in place. This will engage the foot members 58 with the attachment members 60 and position the upper portion of the log cluster 46 above the open top 18 and lip 20. If it is desired to expose all or substantially all of the log cluster 46 above the open top 18, then the log cluster 46 may be moved or raised to its third vertical position as described above and then rotated to lock it in place. In either vertical position, the flame 100 can be adjusted to form a small flame or a large flame reaching 8–12 inches above the top of the log cluster 46 to simulate, respectively, a small or a large wood burning campfire. It should be noted, however, that the device 10 is not intended for cooking when the log cluster 46 is in its second or third vertical position within the container 12.

As can be seen from the above, the present invention provides a portable artificial campfire device that is self-contained, does not require additional fuel sources and can be used as a cooking device. The device of the present invention is safe and is ecologically-minded due to the fact that it does not burn fossil fuel sources such as wood, charcoal and the like, thereby avoiding smoke and other emissions. The present invention meets the National Forest Service requirements for a legal fire during a no wood burning ban. Therefore, it provides the warmth and beauty of an open campfire during times that traditional wood burning campfires are prohibited. The device of the present invention also provides an instant on-off capability with either hot blue flames or natural orange flames. Moreover, flames of various desired heights can be created utilizing the present invention. The artificial logs utilized with the present invention provide not only visual sensory benefits but also retain heat for continued warmth even after the gas source has been turned off. The present invention is especially useful for camping, particularly where wood burning and noise from wood cutting is prohibited. It is, however, also useful for ice fishing, night fishing, river rafting, beach parties, tail gate parties, barbecues, picnics, emergencies, ski trips and the like. It is useful in virtually any situation where a campfire would be desirable or enjoyable but not permissible under the circumstances. Moreover, it is also useful where a gas fueled cooking device would be desirable in conjunction with the ability to have an artificial campfire.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

We claim:

1. A portable artificial campfire device comprising:

a receptacle having upper and lower portions, an open top defined by a peripheral edge of said upper portion, and an interior bottom surface;

burner means positioned above said interior bottom surface adapted to provide a flame of variable height;

a pressurized fuel source positioned exterior to said receptacle;

control means coupling said fuel source with said burner means for controlling the flow of fuel to said burner means and the size of flame emitted by said burner means;

a plurality of artificial refractory log members secured to each other in crisscross fashion to form a log cluster;

means for supporting said log cluster within said receptacle; and means for selectively adjusting the vertical position of said log cluster within said receptacle to vary the vertical position of said log cluster relative to the plane of said open top.

2. The device as claimed in claim 1, wherein said device further includes means for selectively mounting a grill member over said open top when said log cluster is positioned within said receptacle below the plane of said open top.

3. The device as claimed in claim 2, wherein said grill member comprises a plurality of spoke arms radiating from a central hub, each said spoke arm having a notched distal end sized for engagement with said upper portion peripheral edge.

4. The device as claimed in claim 1, wherein said log cluster support means comprises a plurality of support arms projecting vertically downwardly from said log cluster.

5. The device as claimed in claim 4, wherein each said support arm includes a foot member disposed at the distal end thereof, said foot member being adapted to a engage said interior bottom surface to define a first vertical position for said log cluster within said receptacle wherein said log cluster is positioned below the plane of said open top.

6. The device as claimed in claim 5, wherein said receptacle includes at least one set of attachment means disposed about the interior surface thereof adapted to selectively engage said foot members to define at least a second vertical position for said log cluster within said receptacle wherein said log cluster projects vertically upwardly beyond the plane of said open top.

7. The device as claimed in claim 6, wherein said receptacle includes a second set of attachment means disposed about the interior surface thereof between said first set of attachment means and said open top to define a third vertical position for said log cluster within said receptacle.

8. The device as claimed in claim 1, wherein said receptacle lower portion includes a plurality of vent openings disposed about the periphery thereof.

9. The device as claimed in claim 1, wherein said burner means is disposed at least 4 inches above said interior bottom surface.

10. A portable artificial campfire device utilizing pressurized gas to simulate a natural wood burning campfire, said device comprising:

a container having a substantially closed base portion, an open-ended top portion including an annular top edge defining the open end thereof, an interior bottom surface and an interior peripheral surface;

a burner mounted in said base portion spaced above said bottom surface;

a pressurized gas source disposed exterior of said container;

a fuel regulator coupling said gas source to said burner for controlling the flow of pressurized gas to said burner as well as for controlling the size of flame emitted by said burner;

a plurality of refractory log members having upper and lower ends and secured crisscross to each other in tepee-like alignment to form a log cluster simulating campfire logs;

means for supporting said log cluster within said container; and means for selectively adjusting the vertical alignment position of said log cluster within said container to vary the vertical alignment position of said log cluster within said container relative to said open-ended top portion.

11. The device as claimed in claim 10, wherein said log cluster support means comprises a plurality of support arms having upper and lower ends, the upper ends of said support arms being secured to the lower ends of said logs of said cluster of logs, and the lower ends of said support arms having foot members sized and shaped to support the vertical alignment position of said log cluster within said receptacle.

12. The device as claimed in claim 11, wherein said vertical alignment adjustment means comprises at least a first and a second set of attachment members with each said set including a plurality of attachment members disposed about the interior peripheral surface of said container, said second set being positioned between said first set and said container open end, and wherein said foot members are adapted to engage said interior bottom surface to define a first vertical position for said log cluster within said container wherein said log cluster is positioned below the plane of said open top, and are further adapted to engage said first and second set of attachment members, said first set of attachment members defining a second vertical position for said log cluster wherein said log cluster projects partially above the plane of said open top, and said second set of attachment members defining a third vertical position for said log cluster wherein said log cluster projects substantially above the plane of said open top.

13. The device as claimed in claim 12, wherein each said foot member comprises a substantially L-shaped support element, and wherein each said attachment member comprises a bracket projecting from said interior peripheral surface having a socket sized and shaped for receiving said support element, the support elements of said log cluster being rotatively coupled with said attachment member brackets.

14. The device as claimed in claim 10, wherein said device further includes means for selectively mounting a grill member over said open end when said log cluster is positioned within said container below the plane of said open end, said grill member comprising a plurality of spoke arms radiating from a central hub, each said spoke arm having a notched distal end sized for engagement with said interior peripheral edge.

15. The device as claimed in claim 10, wherein said receptacle is in the form of a corrugated metal can, wherein said substantially closed base portion includes a plurality of vent openings disposed about the periphery thereof, and wherein said burner is disposed at least 4 inches above said interior bottom surface.

16. A combination portable cooking and artificial campfire device utilizing pressurized gas, said device comprising:

a container having a substantially closed lower portion, an upper portion, an open top defined by a peripheral top edge, an interior bottom surface and an interior peripheral surface;

a gas burner mounted in said base portion spaced above said bottom surface;

a pressurized gas source disposed exterior to said container;

a fuel regulator coupling said gas source to said burner for controlling the flow of pressurized gas to said burner as well as for controlling the size of flame emitted by said burner;

a plurality of refractory log members having upper and lower ends and secured crisscross to each other to form a tepee-shaped log cluster simulating a natural wood burning campfire when said cluster is positioned above the plane of said open top;

means for supporting said log cluster within said container;

means for selectively adjusting the vertical position of said log cluster within said container to vary the vertical position of said log cluster within said container relative to the plane of said open top between a first vertical position wherein said log cluster is positioned below said plane and at least one second vertical position wherein said cluster is positioned above said plane; and means for selectively mounting a grill member over said open end when said log cluster is positioned in said first vertical position.

17. The device as claimed in claim 16, wherein said log cluster support means comprises a plurality of support arms having upper and lower ends, the upper end of each said support arm being imbedded in the lower end of one said refractory log, and the lower end of each said support arm including a foot member in the form of an L-shaped support element sized and shaped to support each vertical alignment position of said log cluster within said container.

18. The device as claimed in claim 17, wherein said vertical alignment adjustment means comprises at least first and second sets of attachment brackets disposed about the interior peripheral surface of said container with each said bracket having a socket sized and shaped for receiving one said support element, said second set of brackets being positioned between said first set of brackets and said container open end, and wherein said foot members are adapted to engage said interior bottom surface to define said first log cluster vertical position and are further adapted to engage said first and second sets of attachment brackets, said first set of attachment brackets defining a second vertical position for said log cluster wherein said log cluster projects partially above the plane of said open top, and said second set of attachment brackets defining a third vertical position for said log cluster wherein said log cluster projects substantially entirely above the plane of said open top, the support elements of said log cluster being rotatively coupled with said attachment brackets.

19. The device as claimed in claim 16, wherein said container is in the form of a corrugated metal can having exterior ridges and grooves, wherein said substantially closed lower portion includes a plurality of vent openings disposed in the exterior ridges about the periphery thereof, and wherein said burner is disposed 4–8 inches above said interior bottom surface.

20. The device as claimed in claim 16, wherein said burner and fuel regulator are adapted to create flames up to 8–9 inches above said log cluster when positioned above the plane of said open top, and wherein said log cluster is adapted to retain heat for cooking when said log cluster is positioned below the plane of said open top.

* * * * *